US005612931A

United States Patent [19]

Sato et al.

[11] Patent Number: 5,612,931

[45] Date of Patent: Mar. 18, 1997

[54] SWITCH DEVICE AND ELECTRONIC INSTRUMENTS EQUIPPED WITH THE SWITCH DEVICE

[75] Inventors: Hiroshi Sato; Masayoshi Okuyama; Nobuhiro Aoki, all of Tokyo, Japan

[73] Assignee: Casio Computer Co., Ltd., Tokyo, Japan

[21] Appl. No.: 498,171

[22] Filed: Jul. 5, 1995

[30] Foreign Application Priority Data

Jul. 7, 1994 [JP] Japan ..... 6-180579
Dec. 8, 1994 [JP] Japan ..... 6-304882

[51] Int. Cl.[6] ..... G04B 19/30

[52] U.S. Cl. ..... 368/67; 368/227

[58] Field of Search ..... 368/67, 227

[56] References Cited

U.S. PATENT DOCUMENTS 3,963,885 6/1976 Brien ..... 368/227
4,003,197 1/1977 Haber ..... 368/67
4,095,408 6/1978 Kashio .
4,135,067 1/1979 Bitko .
4,775,964 10/1988 Alessio et al. .
4,912,688 3/1990 Syfert .

FOREIGN PATENT DOCUMENTS 1540562 7/1977 England .
2449071 4/1976 Germany .
2828566 1/1979 Germany .

*Primary Examiner*—Bernard Roskoski
*Attorney, Agent, or Firm*—Frishauf, Holtz, Goodman, Langer & Chick

[57] ABSTRACT

When an electronic instrument has taken a predetermined attitude, an attitude-detecting switch incorporated in the instrument detects the attitude, and outputs a switch signal to a CPU. The CPU, in turn, drives a lighting device for lighting a liquid crystal display device. The lighting device is driven, for example, only when a predetermined number of pulses of the switch signal are generated within a predetermined period of time, or only when the switch signal has continued for a predetermined period of time or more. Thus, there are cases where the lighting device is not driven irrespective of the generation of the switch signal. As a result, the lighting device is prevented from operating so often, and hence the life of its battery is lengthened.

10 Claims, 15 Drawing Sheets

SWITCH DEVICE AND ELECTRONIC INSTRUMENTS EQUIPPED WITH THE SWITCH DEVICE

BACKGROUND OF THE INVENTION

1. Field of the Invention

This invention relates to a switch device suitable to an electronic instrument to be mounted on a wrist, such as a wristwatch, and the electronic instrument itself.

2. Description of the Related Art

Recently, wristwatches which can digitally indicate time, date, etc. on a liquid crystal display panel have been widely spread. In such wristwatches, data displayed on the liquid crystal display panel can be seen with ambient light in the daytime, but cannot be seen in the nighttime if there is no illumination. Therefore, some wristwatches are equipped with built-in lighting devices for lighting their liquid crystal display panels. In general, a lighting device of this type is turned on by operating a lighting switch. Further, also in the case of an analog watch which indicates time by hands, an EL (Electroluminescence) device, for example, is provided on the dial of the watch for lighting the dial when it has been turned on by a switching operation.

However, the conventional lighting switch built in a wristwatch is hard to operate and is liable to be erroneously operated since it is usually operated in the darkness in the nighttime.

In particular, in the case of a sports type wristwatch equipped with many functions including a stopwatch function, and hence with many operation switches for executing the functions, it is possible that some switch is mistaken for a lighting switch and wrongly operated, to thereby alter indicated data unintentionally.

Moreover, the lighting device is liable to be unintentionally turned on, with the result that power consumption may increase and the battery built in the wristwatch may have its service life shortened.

SUMMARY OF THE INVENTION

It is the object of the invention to provide a switch device capable of operating various devices built in an electronic instrument in a reliable manner and reducing the power consumption, and the electronic instrument itself with the switch device.

To attain the object, there is provided an electronic instrument, comprising:

display means for displaying data;

attitude-detecting switch means for detecting the attitude of the instrument itself and outputting a switch signal when the instrument has assumed a predetermined attitude;

a lighting device responsive to the switch signal from the attitude-detecting switch means for lighting the display means; and control means for validating or invalidating the operation of the lighting device based on the switch signal.

In the invention constructed as above, the switch device can operate in a reliable manner without being unintentionally turned on and off. Further, since unintentional turning on and off of the lighting device is prevented, the power consumption of the electronic instrument can be saved.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

First Embodiment

Figure 1:
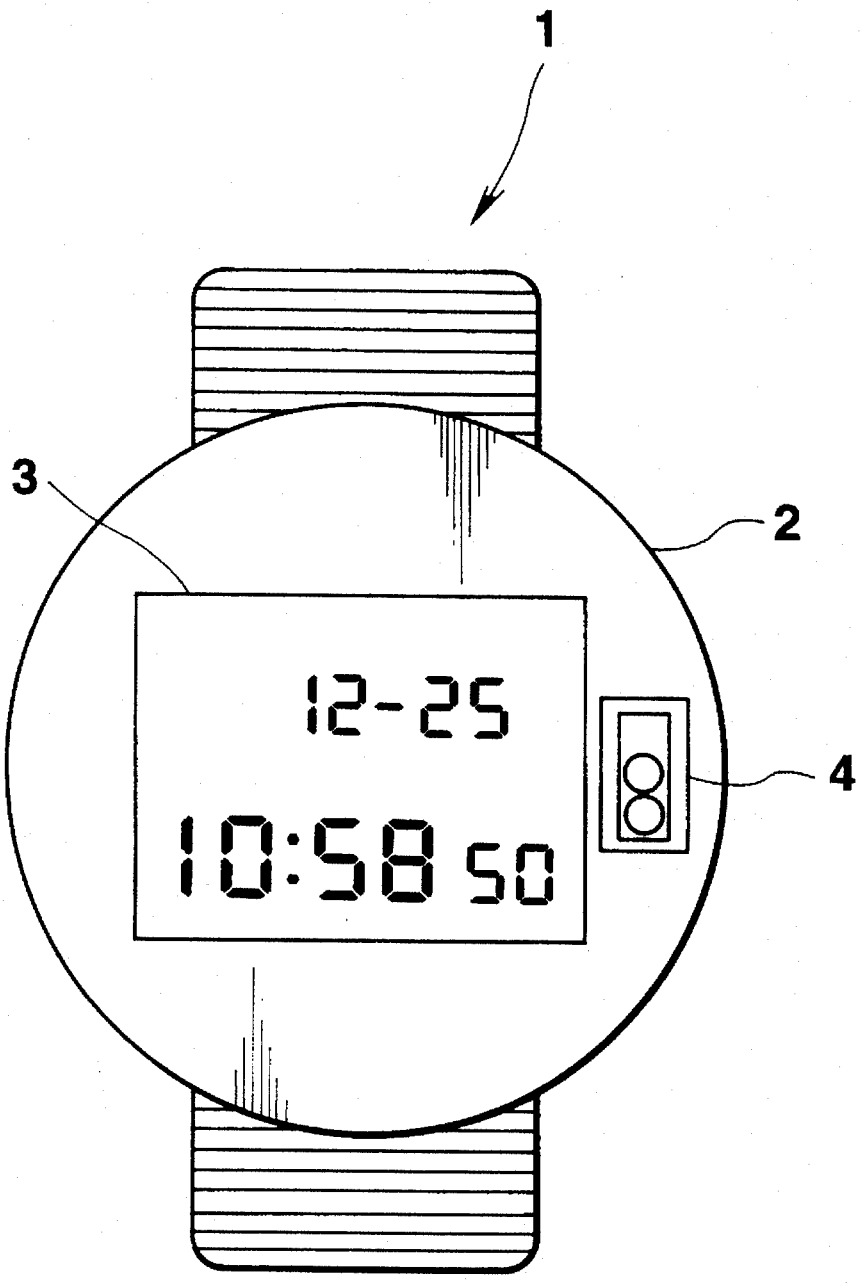
FIG. 1 is a plan view, showing an appearance of a digital electronic wristwatch according to the invention.

FIG. 1 is a plan view, showing an appearance of a digital electronic wristwatch 1 (hereinafter referred to simply as "wristwatch 1"). The wristwatch 1 includes a case 2, a liquid crystal display 3 (corresponding to an LCD 17 which will be described later) mounted on the case 2 for digitally indicating time and date thereon, and an attitude switch 4 contained in the case 2 for detecting an inclination of the wristwatch 1 and performing a switching operation.

Figure 2:
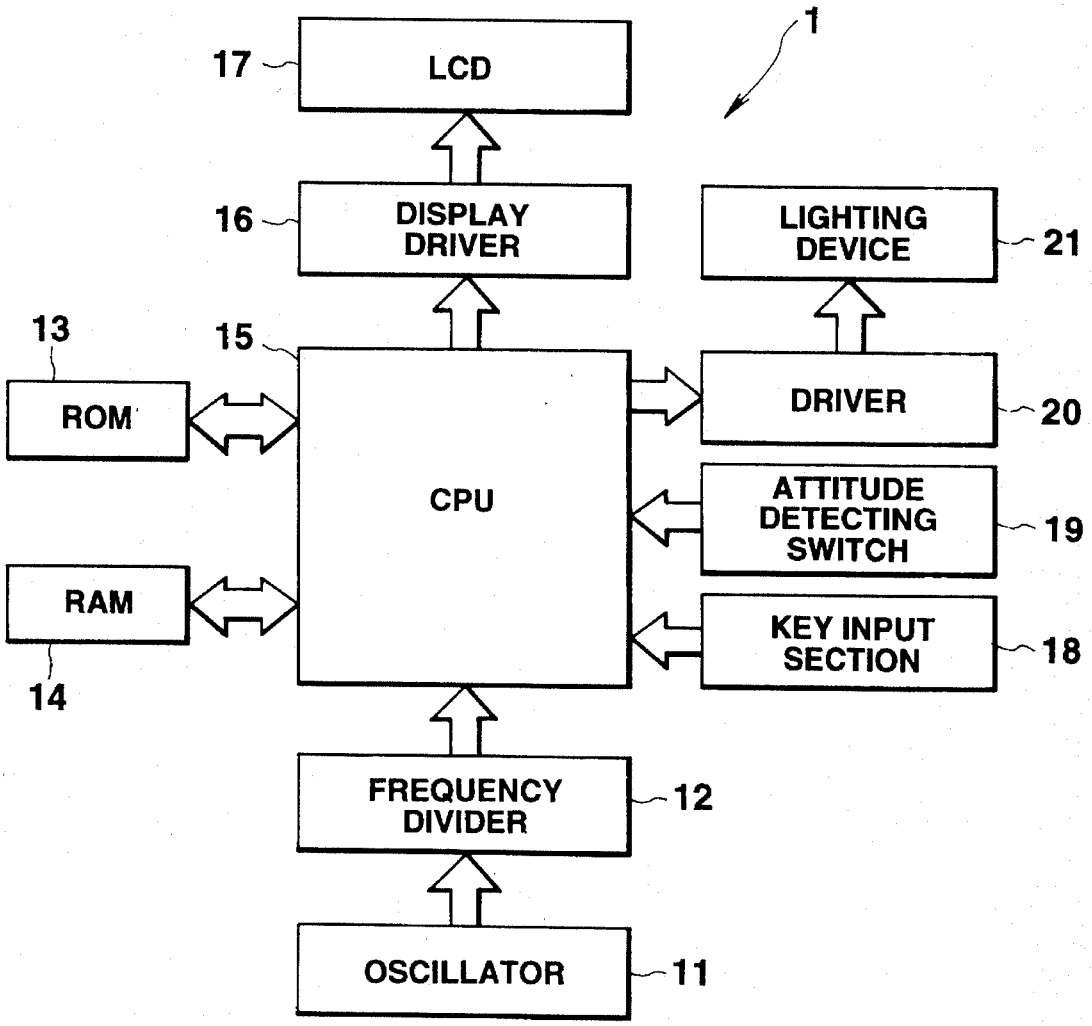
FIG. 2 is a block diagram, showing the circuit of the digital electronic wristwatch of FIG. 1.

FIG. 2 is a block diagram, showing the circuit of the wristwatch 1. 10 As is shown in FIG. 2, the wristwatch 1 comprises an oscillator 11, a frequency divider 12, a ROM 13, a RAM 14, a CPU 15, a display driver 16, an LCD 17, a key input section 18, an attitude detection switch 19, a driver 20 and a lighting device 21.

The oscillator 11 oscillates a fundamental clock signal of e.g. 32.768 kHz for generating operation timing clock signals for each section in the wristwatch 1, and outputs the fundamental clock signal to the frequency divider 12.

The frequency divider 12 frequency-divides the fundamental clock signal to produce a timing signal of a predetermined frequency and a clock signal of a predetermined frequency, and supplies the signals to the CPU 11 and other circuits.

The ROM (Read Only Memory) 13 stores micro programs to be executed by the CPU 15, such as a clock processing program, a display processing program and an illumination control program.

Figure 3:
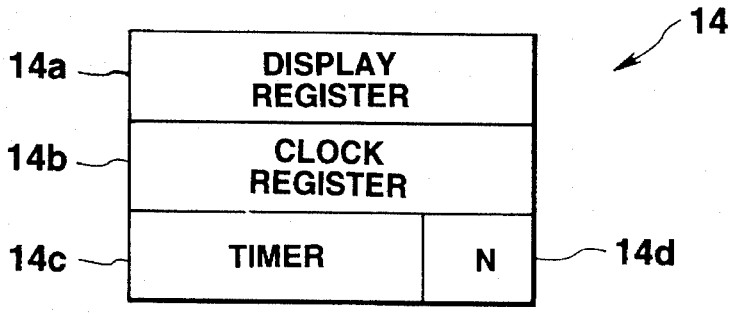
FIG. 3 is a view, showing the structure of a RAM appearing in FIG. 2.

The RAM (Random Access Memory) 14 has, as shown in FIG. 3, a display register 14*a* for storing display data, a clock register 14*b* for storing present time data, a timer register 14*c* for setting a detection point of time at which the detection signal of the attitude detection switch 19 is to be detected, and a counter register 14*d* for counting the number of occasions in which the detection signal of the switch 19 is detected, and storing the counted value N.

The CPU (Central Processing Unit) 15 controls each section in the wristwatch 1 in accordance with the control programs stored in the ROM 13. Specifically, upon receiving a time-measuring clock signal output from the frequency divider, the CPU 15 performs clock processing and display processing, thereby supplying the present time data registered in the clock register 14*b* of the RAM 14, to the display register 14*a* of the same, outputting time/date data to the display driver 16, and causing the LCD 17 to display the time/date data. The CPU 15 further performs various processing other than the above in accordance with various instruction signals input from the key input section 18.

Moreover, the CPU 15 executes illumination control processing, which will be explained later, thereby outputting a control signal to the driver 20 to turn on the lighting device 21.

The display driver 16 drives the LCD 17 to display time/date data, in accordance with display data obtained as a result of the clock processing and the display processing in the CPU 15, and display data obtained as a result of the processing in the CPU 15 according to the key operation of the key input section 18.

The key input section 18, which comprises a time setting key, a date setting key, etc., supplies the CPU 15 with an instruction signal obtained by a key operation.

Figure 4:
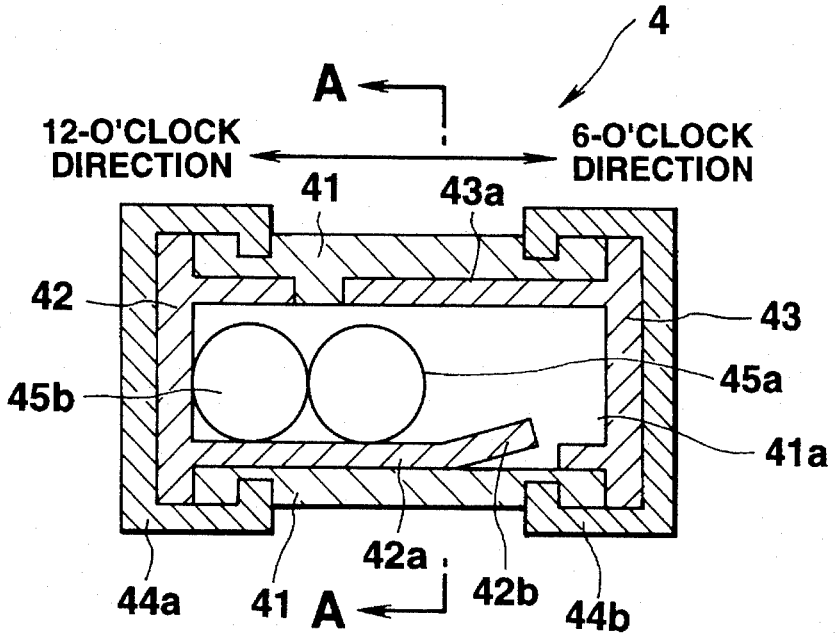
FIG. 4 is a cross sectional view, showing an attitude detecting switch.
Figure 5:
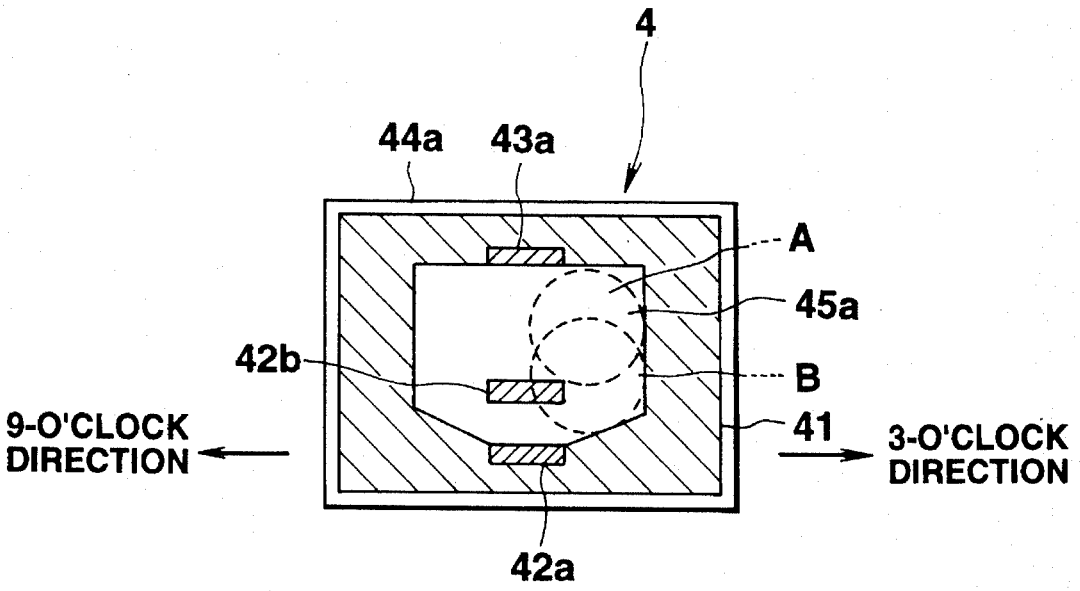
FIG. 5 is a view, taken along lines A—A of FIG. 4.

The attitude detection switch 19, which has an attitude detection function, corresponds to the attitude detection switch 4 contained in the case 2 of the wristwatch 1. Referring then to FIGS. 4 and 5, the attitude detection switch 4 will be explained.

The attitude detection switch 4 is contained in the wristwatch 1 such that its right and left directions (in FIG. 4) correspond to 12-o'clock and 6-o'clock directions of the wristwatch 1, respectively. Further, an upper portion of the detection switch 4 is positioned in an upper portion of the wristwatch 1 parallel to the upper surface of e.g. the case 2, while a lower portion of the switch 4 is positioned in a lower portion of the wristwatch 1 parallel to the lower surface of e.g. the case 2.

The attitude detection switch 4 has a housing 41 of a synthetic resin and first and second conductive stationary contacts 42 and 43 opposed to each other and received in a hole 41*a* which is formed in the housing 41. More specifically, the first stationary contact 42 is provided on that side end of the hole 41*a* which is located in the 12-o'clock direction of the wristwatch 1, and the second stationary contact 43 is provided on that side end of the hole 41*a* which is located in the 6-o'clock direction of the wristwatch 1.

The first stationary contact 42 has an extension 42*a* extending in the 6-o'clock direction of the wristwatch, while the second stationary contact 43 has an extension 43*a* extending in the 12-o'clock direction of the wristwatch 1 and opposed to the extension 42*a*. The extension 42*a* of the first stationary contact 42 has an inclined end portion 42*b* obliquely extending toward the extension 43*a* of the second stationary contact 43.

Metallic caps 44*a* and 44*b* are provided on the outer surfaces of the stationary contacts 42 and 43, respectively. The caps 44*a* and 44*b* are connected to a circuit board (not shown) by means of solder, thereby electrically connecting the first and second stationary contacts 42 and 43 to the CPU 15.

As is shown in FIG. 5 taken along lines A—A of FIG. 4, the housing 41 has an inclined inner surface 41*b* inclined to the extension 42*a* of the first stationary contact 42.

Conductive ball members 45*a* and 45*b* of the same size are movably contained in the hole 41*a*. These ball members have a diameter smaller than the distance between the extensions 42*a* and 43*a* and larger than the distance between the end of the inclined end portion 42*b* and the extension 43*a*.

The operation of the attitude switch 4 will now be explained.

Figure 6:
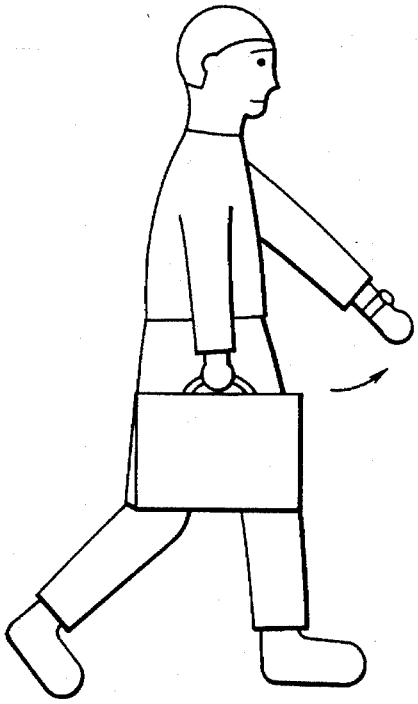
FIG. 6 is a view, showing a state in which the digital electronic wristwatch of FIG. 1 mounted on a wrist of a person is being swung forward and backward.
Figure 7:
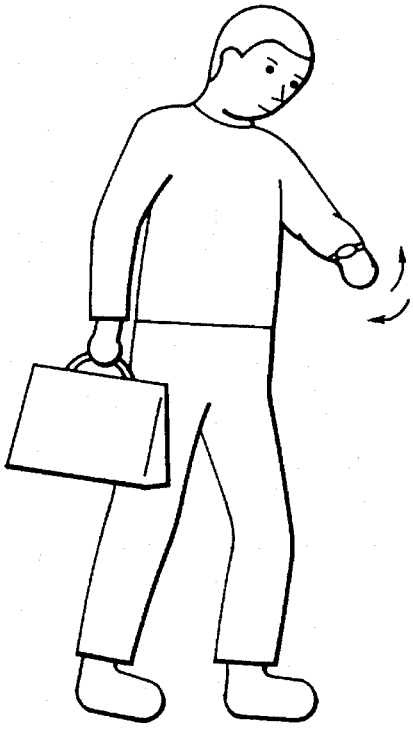
FIG. 7 is a view, showing a state in which the digital electronic wristwatch of FIG. 1 mounted on a wrist of a person are repeatedly inclined such that 12-o'clock and 6-o'clock direction sides of the wristwatch are situated in the lowest position.

The wristwatch 1 is mounted on a wrist of a person as is shown in FIGS. 6 and 7. In a usual state as shown in FIG. 6 wherein the wrist with the wristwatch 1 is regularly swung, the attitude detection switch 4 is inclined such that a 3-o'clock direction side of the wristwatch 1 is situated in a lowest position.

In this state, in the attitude detection switch 4, the conductive ball members 45*a* and 45*b* move in the 3-o'clock direction of the wristwatch 1 by their own weights, and the first and second stationary contacts 42 and 43 are electrically disconnected from each other as indicated by the broken line A in FIG. 5.

At this time, the inclined end portion 42*b*, which is formed as a distal end of the extension 42*a*, displaces the conductive ball member 45*a* toward the second stationary contact 43 as indicated by the broken line B in FIG. 5. However, since the wristwatch 1 inclines such that the 3-o'clock direction side of the wristwatch 1 is situated in the lowest position, the ball member 45*a* and hence the first stationary contact 42 is prevented from contacting the second stationary contact 43.

Thus, the attitude switch 4 is kept in the Off-state.

Figure 8:
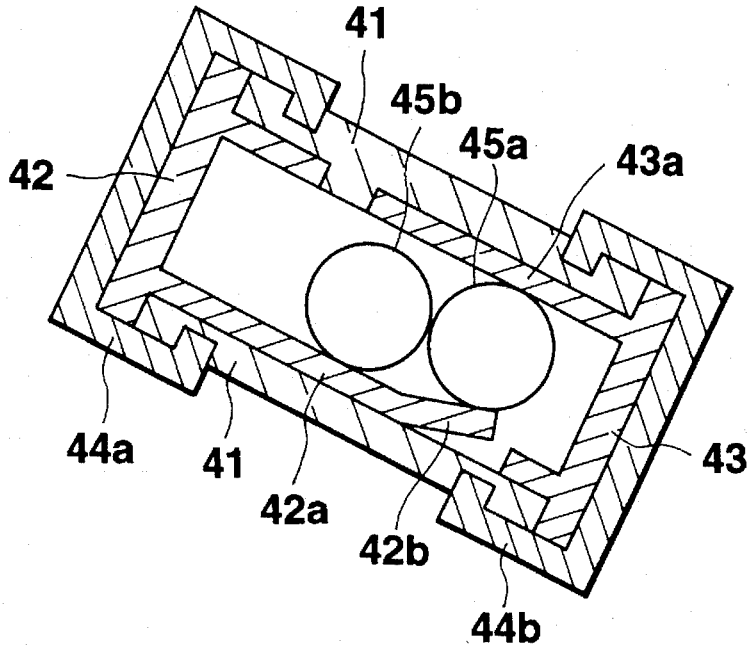
FIG. 8 is a cross sectional view, showing that state of a switch device incorporated in the wristwatch which is assumed when the wristwatch is inclined such that 6-o'clock is situated in the lowest position.

Further, where the arm is bent as shown in FIG. 7 such that the wristwatch 1 is situated in front of the eyes, and the 6-o'clock direction side of the wristwatch 1 is situated in the lowest position, the ball members 45*a* and 45*b* of the attitude detection switch 4 move by their own weights in the 6-o'clock direction of the wristwatch 1, as is shown in FIG. 8.

When the conductive ball member 45*a* positioned close to the second stationary contact 43 has moved toward the second stationary contact 43, it is guided to the extension 43*a* of the second stationary contact 43 by means of the inclined end portion 42*b* of the first stationary contact 42, and brought into contact with the extension 43*a*. As a result, the inclined end portion 42*b* of the extension 42*a* of the first stationary contact 42 is electrically connected to the extension 43*a* of the second stationary contact 43 via the ball member 45*a*, thereby turning on the attitude detection switch 4.

Further, the conductive ball member 45*b* positioned close to the first stationary contact 42 moves by its own weight toward the second stationary contact 43, thereby urging the conductive ball member 45*a* between the extension 42*a* of the first stationary contact 42 and the extension 43*a* of the second stationary contact 43. Thus, the first and second stationary contacts 42 and 43 are securely connected.

Figure 9:
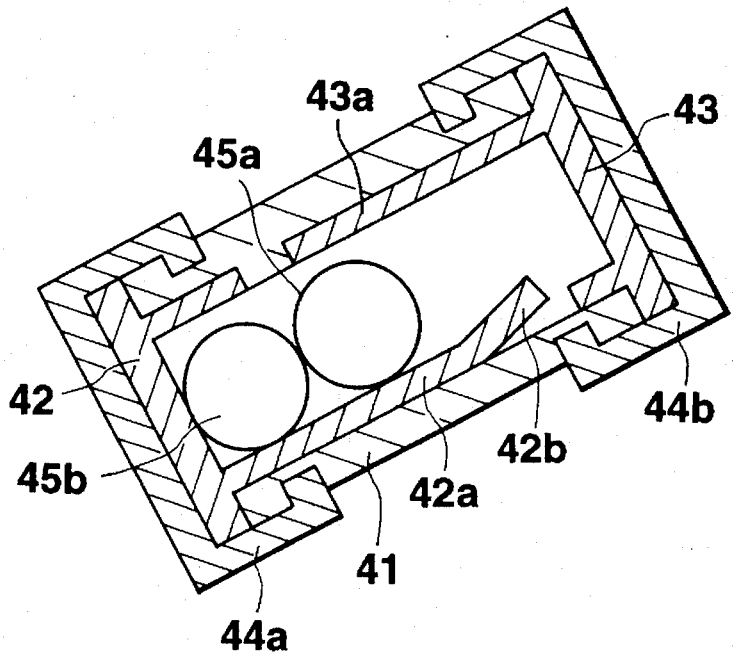
FIG. 9 is a cross sectional view, showing that state of the switch device which is assumed when the wristwatch is inclined such that 12-o'clock is situated in the lowest position.

On the other hand, where the arm is bent such that the 12-o'clock direction side of the dial of the wristwatch 1 is situated in the lowest position, the ball members 45*a* and 45*b* of the attitude detection switch 4 move by their own weights in the 12-o'clock direction of the wristwatch 1, as is shown in FIG. 9.

When the conductive ball member 45*a* positioned close to the second stationary contact 43 has moved from the inclined end portion 42*b* to the extension 42*a*, the first and second stationary contacts 42 and 43 are again separated from each other.

When the wristwatch 1 has been repeatedly inclined in the 6-o'clock and 12-o'clock directions, the attitude detection switch 4 is repeatedly turned on and off. When the On-signal indicative of the on-state of the switch 4 has been repeatedly output to the CPU 15, the CPU 15 executes illumination control processing, which will be explained below, thereby outputting a control signal to the driver 20. As a result, the driver 20 turns on the lighting device 21 to illuminate the LCD 17.

Figure 10:
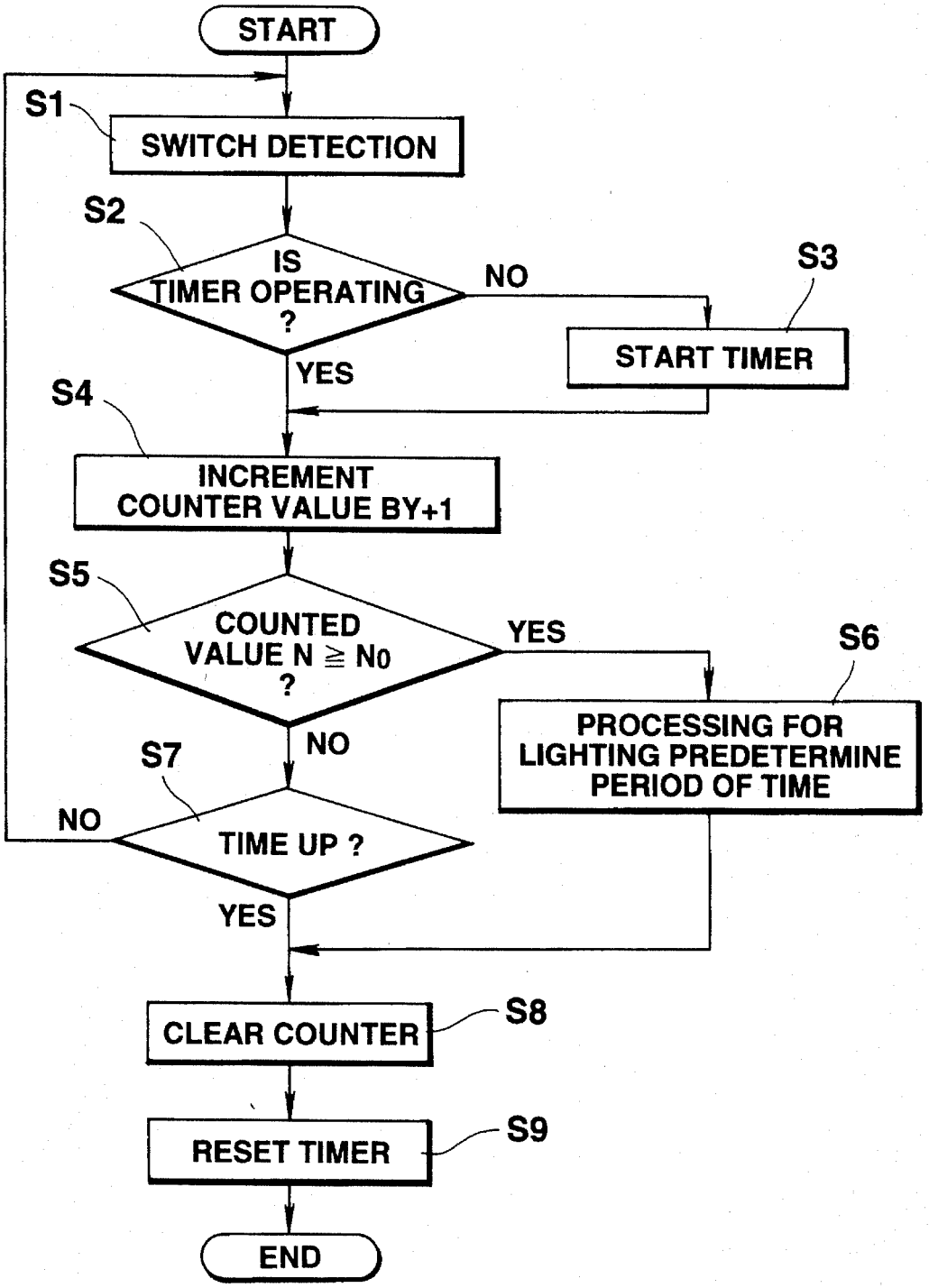
FIG. 10 is a flowchart, useful in explaining lighting control processing performed by a CPU shown in FIG. 2.

Referring then to FIG. 10, the illumination control processing executed by the CPU 15 will be explained.

When the 6-o'clock direction side of the wristwatch 1 mounted on the wrist has been situated in the lowest position as shown in FIGS. 7 and 8, the On-signal is supplied from the attitude detection switch 19 to the CPU 15 and detected by the same (step S1). In the next step S2, it is determined whether or not a timer for successively adding the values of the timer register 14*c* of the RAM 14 with the passing of time operates. If the timer does not operate, the timer is started to operate (step S3). In a step S4, the value N of the counter register 14*d* of the RAM 14 is incremented by +1.

Subsequently, it is determined in a step S5 whether or not the incremented count value N is higher than a predetermined reference value N0 (e.g. 5). If the count value N is higher than the reference value of 5, a control signal is supplied to the driver 20 to light the lighting device 21 for a predetermined time period (step S6), thereby clearing the count value of the counter register 14*d* (step S8), resetting the timer (step S9) and terminating the processing.

Figure 11:
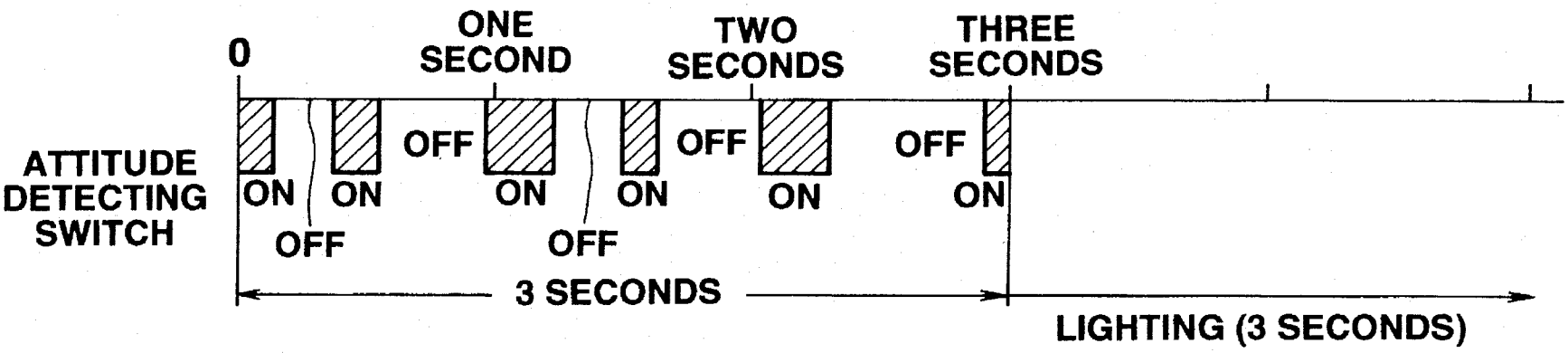
FIG. 11 is a view, showing conditions for detecting that On-signal output from the attitude detecting switch which is processed in the lighting control processing of FIG. 10.

In the above processing, the lighting device 21 is lighted after the On-signal is input from the attitude detection switch 19 more than 5 times (i.e. the signal is input 6 times). FIG. 11 shows the relationship between the On-signal and the detection time. In the FIG. 11 case, the lighting device 21 is lighted for e.g. 3 seconds.

On the other hand, if it is determined in the step S5 that the count value N is lower than the reference value of 5, it is determined in a step S7 whether or not the value of the timer has reached a predetermined value, i.e. whether or not the value of the timer register 14*d* exceeds 3 seconds. If the timer value does not reach the predetermined value, the program returns to the step S1 and the processes in the steps S1 to S6 are repeated. If, on the other hand, the timer value reaches the predetermined value, the count value of the counter register 14*d* is cleared in the step S8, thereby resetting the timer in the step S9 and terminating the processing.

In summary, the lighting device 21 can be lighted for a predetermined time period (e.g. 3 seconds) only when the On-signal from the attitude detection switch 4 has been detected six times within the predetermined time period, as a result of repeatedly inclining the wristwatch 1 in the 6-o'clock and 12-o'clock directions of the wristwatch 1. Therefore, the lighting device 21 is prevented during walking from being turned on and off unintentionally, and can be lighted in a reliable manner without erroneous operations of other switches.

As a result, unintentional lighting of the lighting device can be avoided, thereby saving the power consumption of the wristwatch 1 and lengthening the life of the built-in battery.

Although in the above embodiment, the lighting device 21 is lighted when the On-signal from the attitude detection switch 19 is detected six times within 3 seconds, the conditions for lighting the device 21 may be altered in various manners.

Further, although the lighting device 21 consists of the EL (Electroluminescence) device located below the LCD 17, it may be formed of a lamp, a LED, etc.

Second Embodiment

FIGS. 12 to 15 show a second embodiment of the invention.

Figure 12:
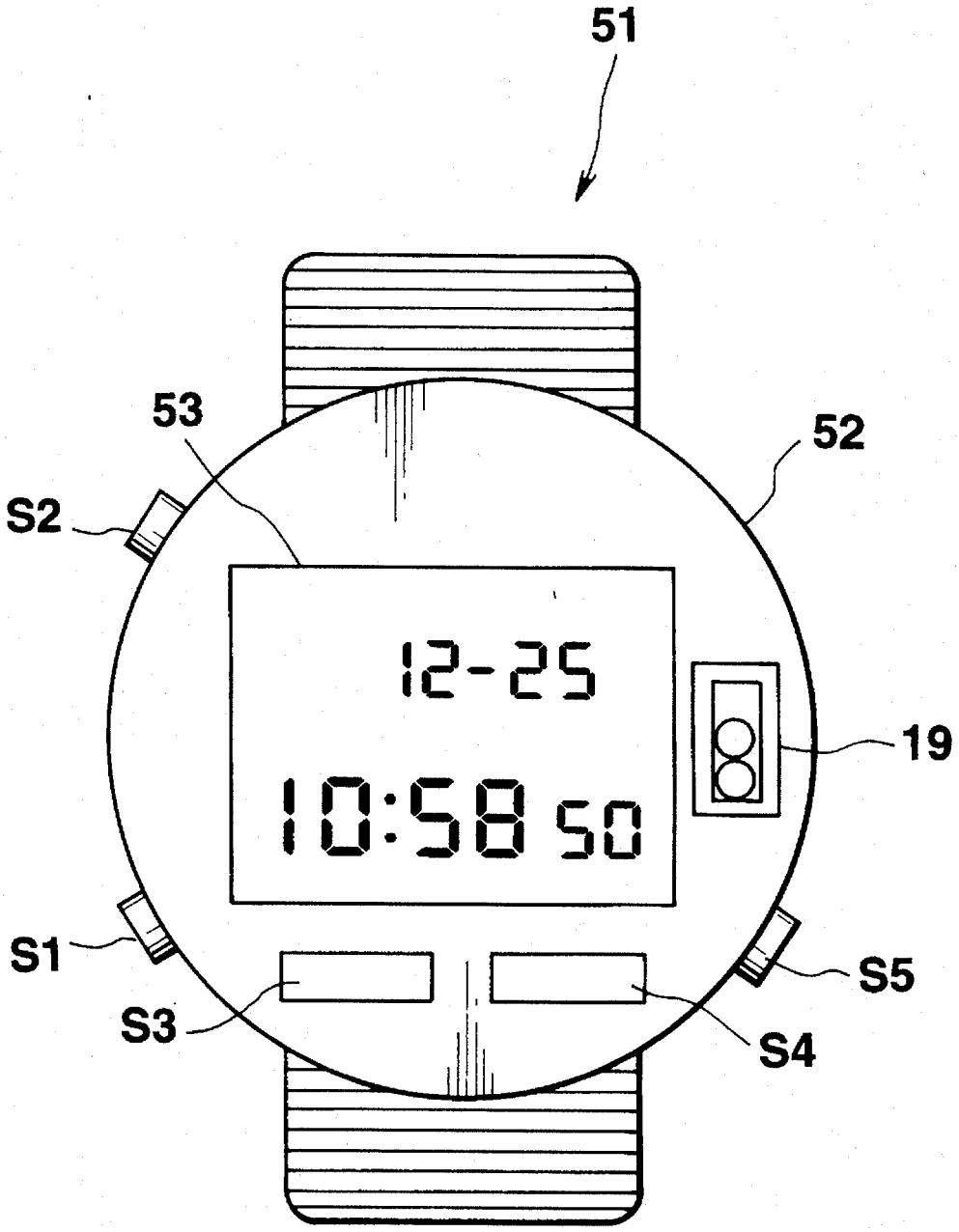
FIG. 12 is a front view, showing an appearance of a wristwatch according to a second embodiment of the invention.

As is shown in FIG. 12, a wristwatch 51 according to the second embodiment includes a case 52, a liquid crystal display 53 mounted on the case 52 for digitally indicating time and date thereon, and an attitude switch 19 contained in the case 52 for detecting an inclination of the wristwatch 1. A lighting device consisting of an electroluminescence device, etc., explained later, is provided on the reverse surface of the liquid crystal display 53. Further, two switches S3 and S4 are mounted on the upper surface of the case 52, and three switches S1 to S3 are mounted on the peripheral surface of the case 52.

The switch S1 is a mode switch to be operated to switch the operation mode. The switch S2 is provided for switching the operation mode between an EL auto-off mode for keeping the lighting device in the Off-state even if an On-signal is supplied from the attitude detection switch 19, and an EL auto-on mode for automatically turning on the lighting device when the On-signal has been supplied from the switch 19. The switch S3 is provided for manually lighting the lighting device. The switches S4 and S5 are provided for correcting time, etc.

Figure 13:
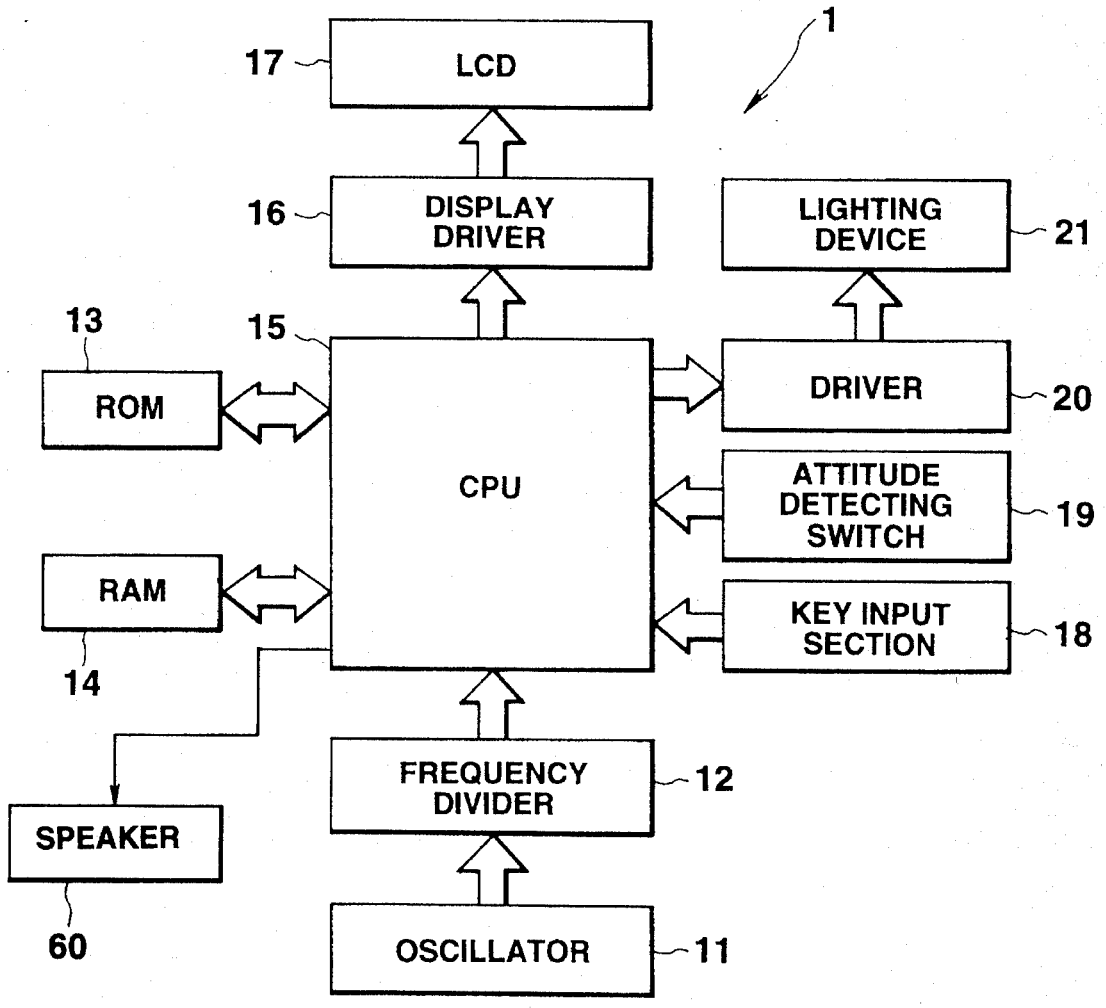
FIG. 13 is a block diagram showing the circuit of the second embodiment.
Figure 16:
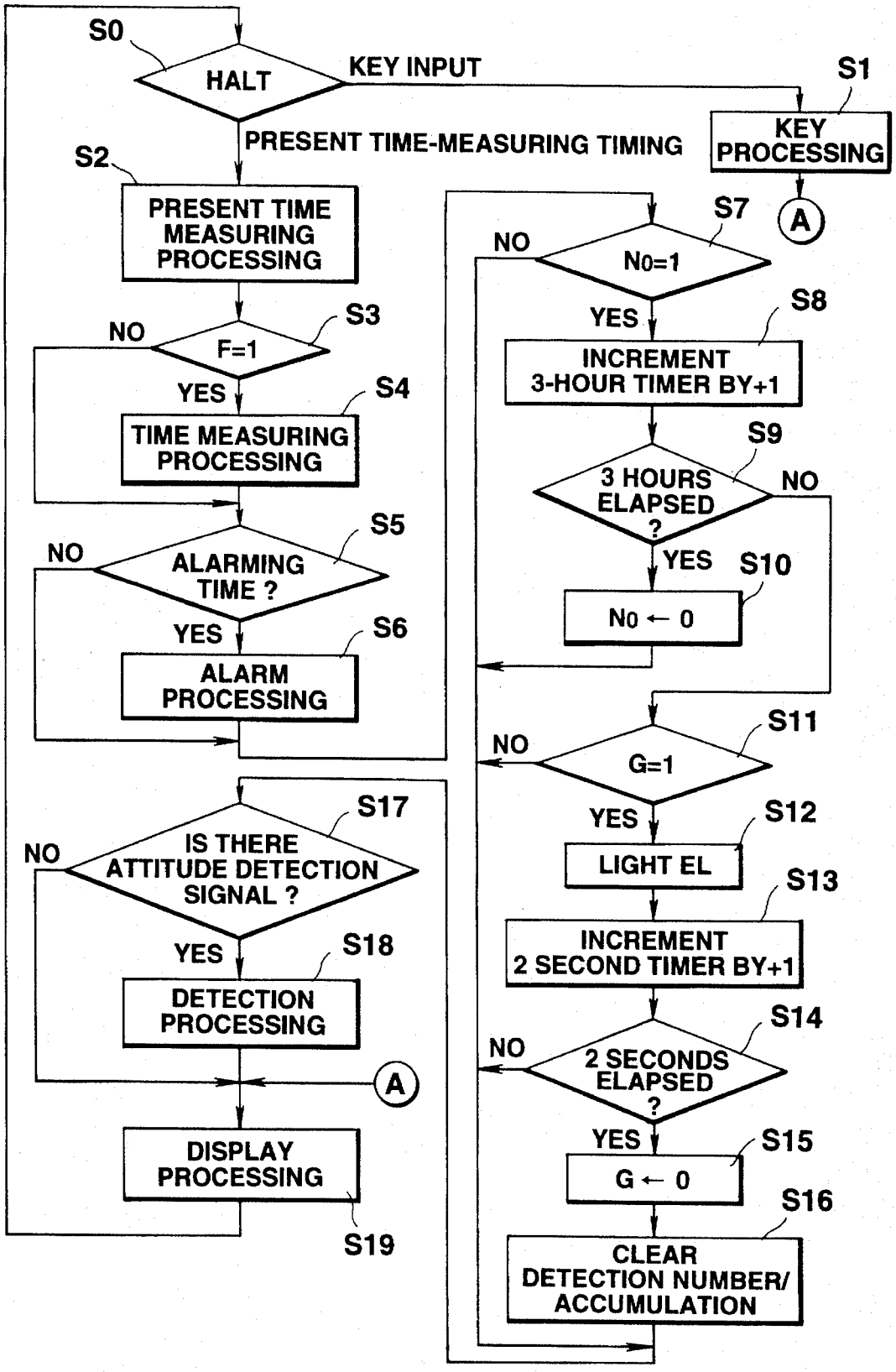
FIG. 16 is a flowchart, useful in explaining the overall operation.
Figure 17:
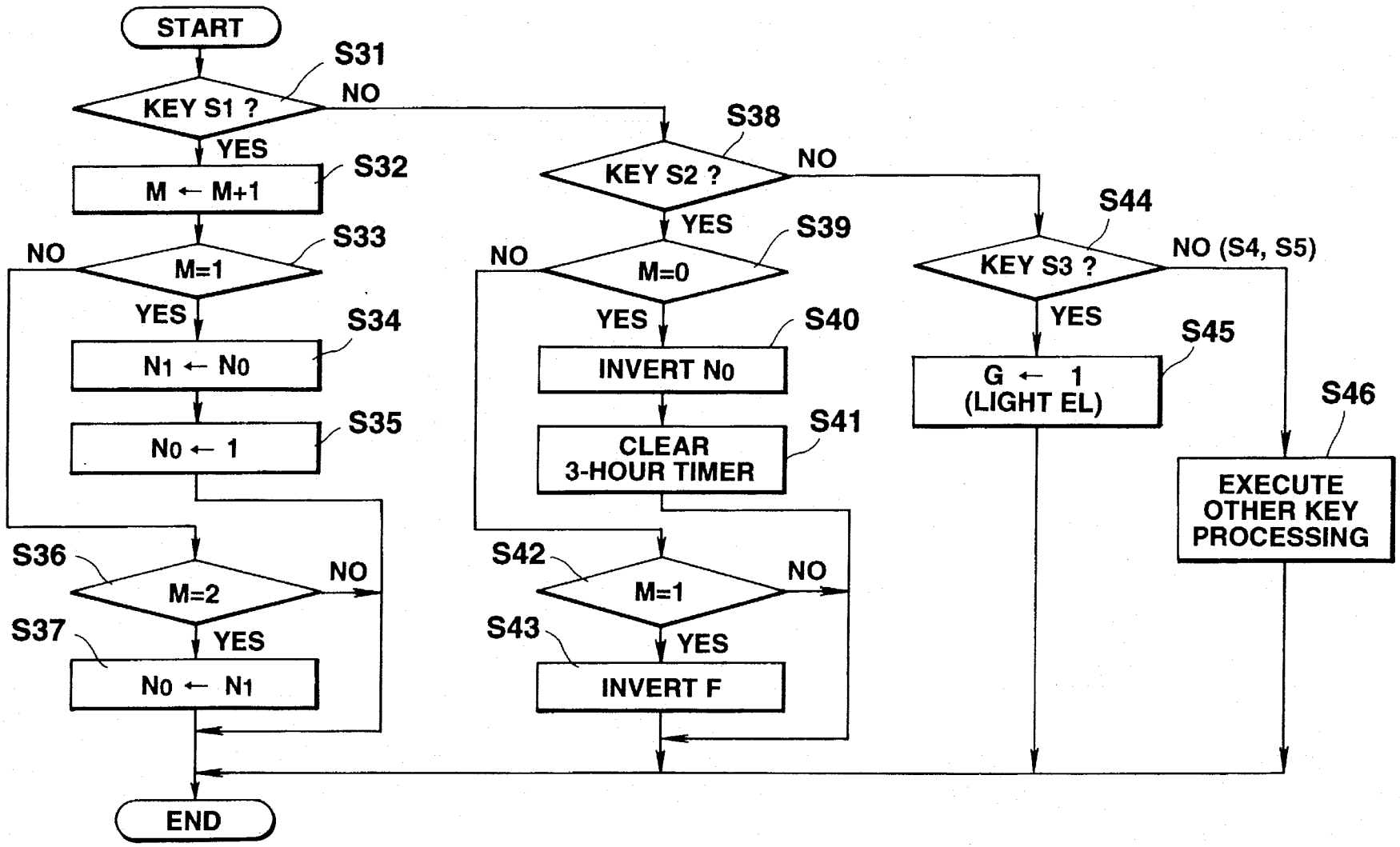
FIG. 17 is a flowchart, useful in explaining key processing shown in FIG. 16.
Figure 18:
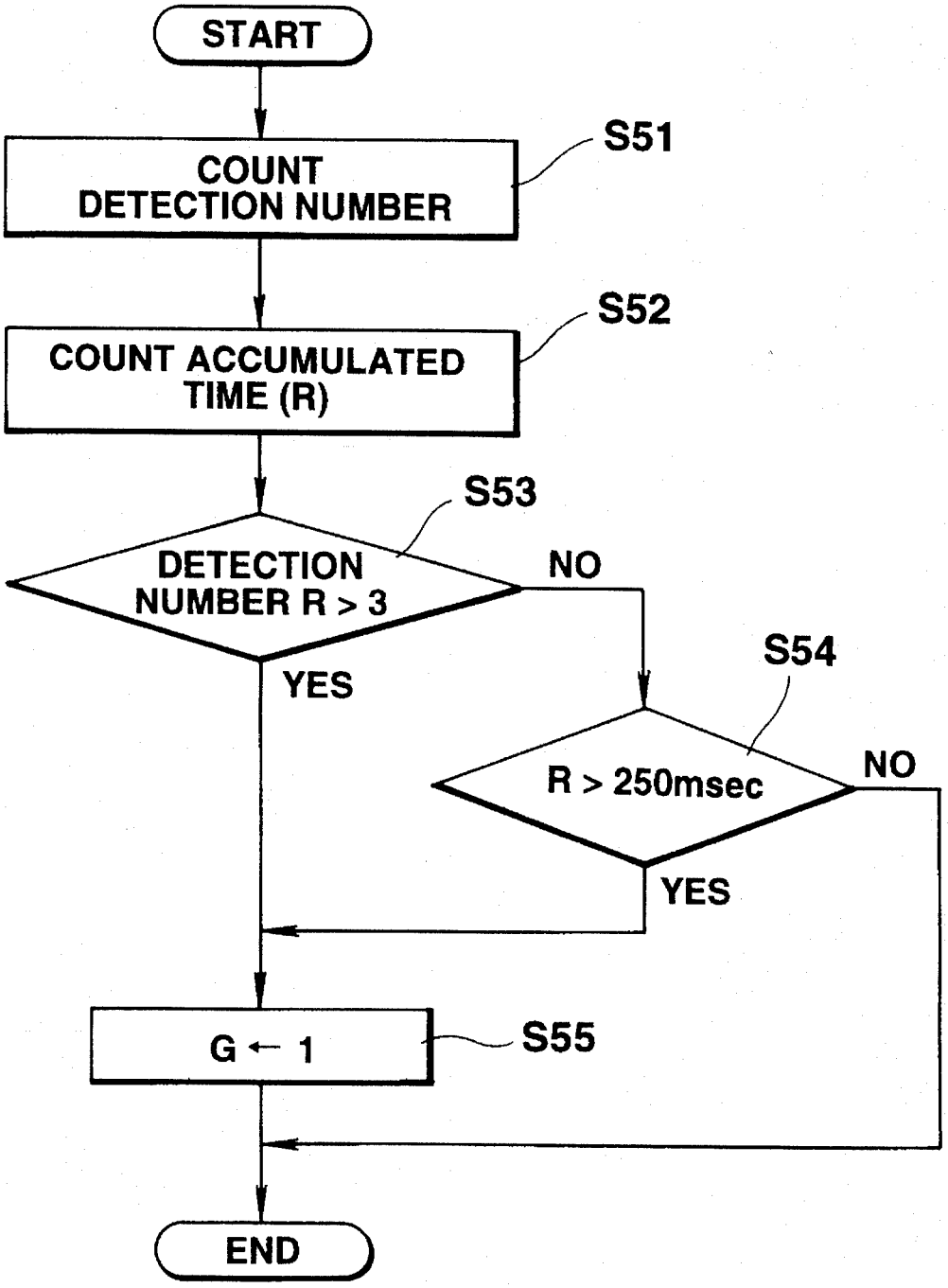
FIG. 18 is a flowchart, useful in explaining detection processing shown in FIG. 16.

FIG. 13 is a block diagram, showing the circuit of the wristwatch 52. The FIG. 13 circuit differs from the FIG. 2 circuit only in that the former employs a speaker 60 driven by a signal from the CPU 15. Therefore, the other elements in FIG. 13 are denoted by corresponding reference numerals, and explanation will be abbreviated. The key input section 18 includes the switches S1 to S5, and the RAM 14 includes various registers which will be explained below with reference to FIG. 14. The LCD 17 includes a display segment which will be explained later with reference to FIG. 15. The CPU 15 stores a microprogram for executing processing as indicated by the flowcharts of FIGS. 16 to 18.

Figure 14:
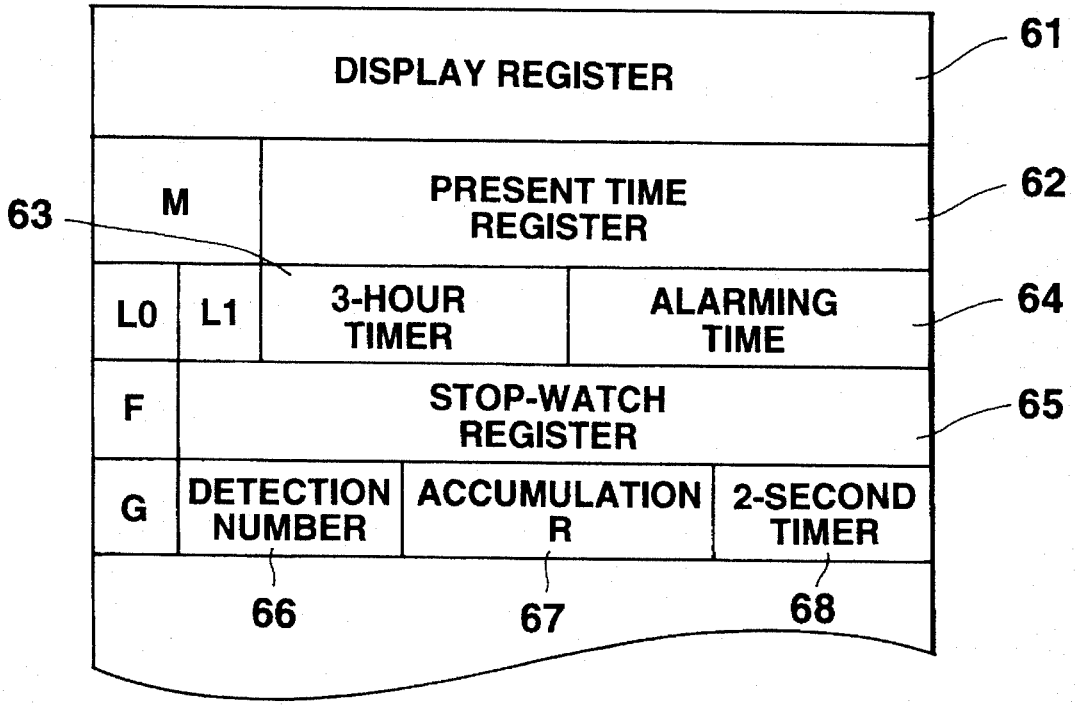
FIG. 14 is a view, showing the structure of a register employed in a RAM shown in FIG. 13.

FIG. 14 shows the structure of registers in the RAM 14. The RAM 14 includes a display register 61 which stores display data for displaying data on the LCD 17, a present-time register 62 for storing data indicative of present date and time, a three-hour timer 63 for measuring a period of time elapsed after automatic turn-on of the lighting device, an alarm time register 64 for storing a set alarm time, a stop-watch register 65 for storing a period of time for which the stop-watch function is executed, an occasion number register 66 for storing the number of occasions in which a predetermined attitude is held for a predetermined time period (e.g. 2 seconds), an accumulated-time register 67 for storing an accumulated value of time periods for which the predetermined attitude is held, and a 2-second timer 68 used to measure 2 seconds.

Moreover, the RAM 14 includes a mode register M for storing values corresponding to operation modes, a register L0 storing data indicative of whether the lighting device is to be automatically turned on or off, a register L1 for temporarily storing the value of the register L0, a flag F indicative of whether or not the stop-watch function is being executed, and a flag G indicative of whether or not the lighting device 21 is being lighted.

The mode register M stores "0" when the operation mode is a clock mode, "1" when it is the stop-watch mode, and "2" when it is an alarm set mode. The register L0 stores "0" when the EL auto-off mode is set, and "1" when the EL auto-on mode is set. The value of the flag F is "1" while the stop-watch function is executed, and "0" while the stop-watch function is not executed. The value of the flag G is "1" while the lighting device 21 is in the On-state, and "0" while it is in the Off-state.

Figure 15:
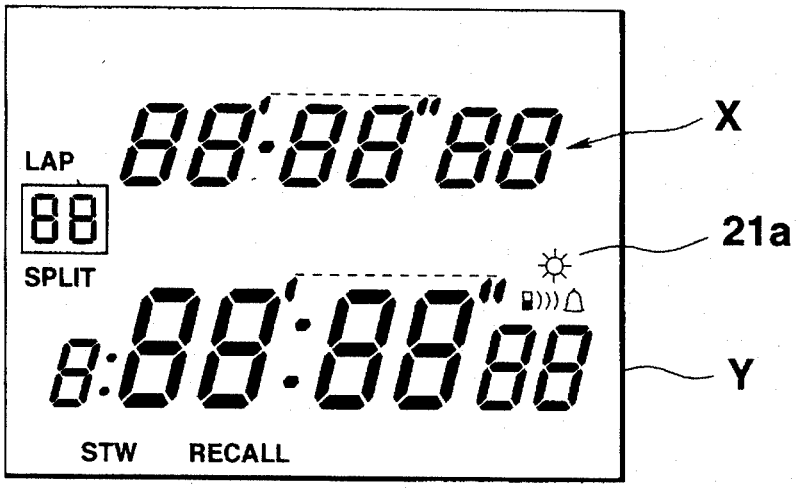
FIG. 15 is a view, showing an LCD 17 shown in FIG. 13.

FIG. 15 shows the display segment of the LCD 17. During the stop-watch function being executed, for example, a lap time is displayed on an upper portion X, and a time period for which the stop-watch function is executed is displayed on a lower portion Y. Further, when the EL auto-on or -off mode is set, an EL auto display mark 21*a* is lighted to inform the user of the mode.

The attitude detection switch 19 has a structure similar to that of the switch shown in FIGS. 4 to 9, and hence its explanation will be omitted.

The operation of the second embodiment will be explained with reference to the flowcharts of FIGS. 16 to 18.

Referring to the flowchart of FIG. 16, the CPU 15 is usually in a halt state as in a step S0. When a point of time at which time detection is to be started has been reached, the program proceeds to a step S2, where the present time is measured. When, on the other hand, key input has been detected, the program proceeds to a step S1, where key processing is performed.

Referring then to the flowchart of FIG. 17, the key processing in the step S1 will be explained.

First, it is determined in a step S31 whether or not a key S1 is being operated. If it is determined that the key S1 is being operated, i.e. if the answer to the question of the step S31 is Yes, the program proceeds to a step S32, where the value of the mode register M is incremented by "1". In the next step S33, it is determined whether or not the value of the mode register M is "1", i.e. whether or not the present operation mode is the stop-watch mode. If it is determined that the stop-watch mode is set, the program proceeds to a step S34, where the value of the register L0 is transmitted to the register L1, and "1" is set in the register L0 in a step S35, thereby setting the EL auto-on mode in which the lighting device 21 is automatically lighted by an On-signal from the attitude control switch 19.

As described above, when the operation mode has been switched to the stop-watch mode (M=1), "1" is set in the register L0, and the EL auto-on mode is set in which the lighting device 21 is automatically lighted by an On-signal from the attitude control switch 19. At this time, the previous value "0" of the register L0 is retreated to the register L1. The previous value "0" is returned to the register L0 after the stop-watch mode is switched to the alarm set mode (M=2) by means of processing, which will be explained later.

If it is determined in the step S33 that the value of the mode register M is not "1", the program proceeds to a step S36, where it is determined whether or not the value of the mode register M is "2", i.e. whether or not the operation mode is the alarm set mode. If it is determined that the alarm set mode (M=2) is set, the program proceeds to a step S37, where the value "0" retreated in the register L1 is returned to the register L0.

If, on the other hand, it is determined in the step S31 that the key S1 is not being operated, the program proceeds to a step S38, where it is determined whether or not a key S2 is being operated. If it is determined that the key S2 is being operated, it is determined in the next step S39 whether or not the value of the mode register M is "0". If the value is "0", i.e. if the key S2 is being operated in the clock mode (M=0), the value of the register L0 is inverted in a step S40, and the three-hour timer 33 is cleared in a step S41.

If it is determined in the step S39 that the value of the mode register M is not "0", the program proceeds to a step S42, where it is determined whether or not the value of the mode register M is "1", i.e. whether or not the key S2 is being operated in the stop-watch mode (M=1). If it is determined that the value is "1", the value of the flag F is inverted in a step S43.

If the value of the flag F is "1", the stop-watch function is executed to measure a period of time. In the stop-watch mode (M=1), the key S2 is operated to start or stop the stop-watch operation.

If it is determined in the step S38 that the key S2 is not being operated, the program proceeds to a step S44, where it is determined whether or not a key S3 is being operated. If it is determined that the key S3 is being operated, the value of the flag G is set to "1", thereby lighting the lighting device 21 while the key S3 is operated.

If it is determined in the step S44 that the key S3 is not being operated, which means that a key S4 or S5 is being operated, the program proceeds to a step S46 where other key processing is performed.

Figure 19:
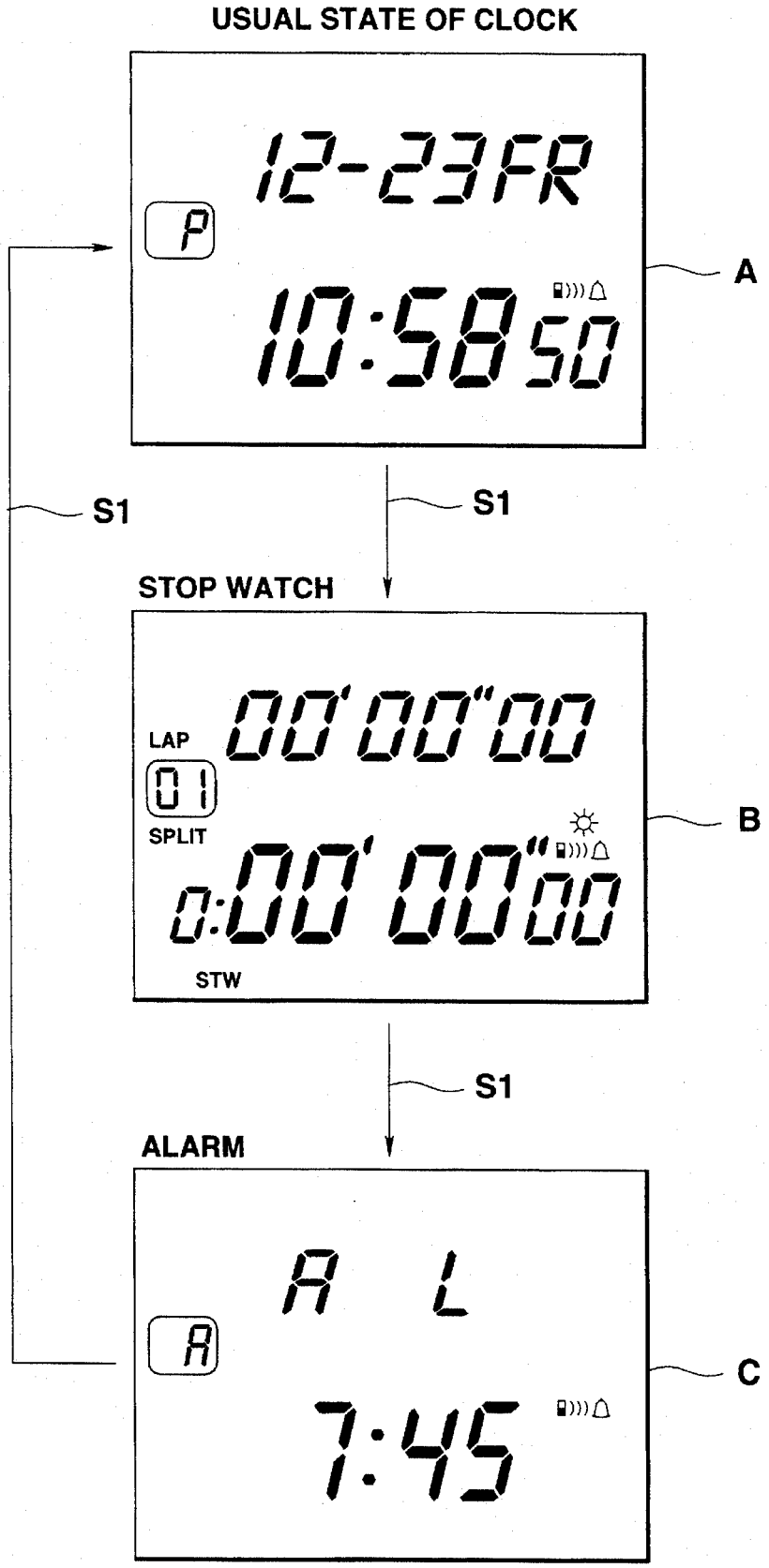
FIG. 19 is a view, useful in explaining the state of indication.

The switching of the operation mode performed when the key S1 is being operated will be explained with reference to FIG. 19. First, when the key S1 has been operated in the clock mode, as indicated by A in FIG. 19, for displaying date and present time, the clock mode is switched to the stop-watch mode as indicated by B in FIG. 19. If the key S2 is operated in the stop-watch mode, time measurement is started. Again operating the key S2 switches the stop-watch mode to the alarm set mode as indicated by C in FIG. 19. In the alarm set mode, alarming time can be set or released. If the key S1 is operated in the alarm set mode, the operation mode is returned to the clock mode.

Referring again to FIG. 16, when the CPU 15 is in a halt state, the present time measurement processing in the step S2 is executed. In the present time measurement processing, the present time is measured on the basis of a clock signal output from the frequency divider, and date and time data obtained by the present time measurement are stored in the present time register 62. In the next step S3, it is determined whether or not the value of the flag F is "1", i.e. whether or not the stop-watch function is being executed. If the value of the flag F is "1" and the stop-watch function is being executed, the program proceeds to a step S4, where time measurement processing is performed. In the time measurement processing, the pulses of the clock signal output from the frequency divider are counted to thereby measure a period of time elapsed from the start of the stop-watch function, and the measured time period is stored in the stop-watch register 65.

If the answer to the question of the step S3 is No, or after the processing in the step S4, it is determined in a step S5 whether or not the present time is identical to the set alarm time. If it is determined that they are identical to each other, i.e. if the answer to the question of the step S5 is Yes, an alarm sound is generated from the speaker 60 in the next step S6.

In a step S7, it is determined whether or not the value of the register L0 is "1". If the value of the register L0 is "1", i.e. if the mode for lighting the lighting device 21 is set (i.e. the answer to the 10 question of the step S7 is Yes), the value of the three-hour timer 63 is incremented by "1" in a step S8, and it is determined in a step S9 whether or not the time period measured by the three-hour timer 63 has reached 3 hours. If it is determined in step S9 that the time period has reached 3 hours, the value of "0" is set in the register L0 to switch the operation mode to the EL auto-off mode for prohibiting lighting of the lighting device 21.

In other words, even if the mode for lighting the lighting device 21 when the On-signal is supplied from the attitude control switch 19 is set, the mode is switched to the EL auto-off mode three hours after the setting of the first-mentioned mode, thereby preventing the lighting device 21 from lighting.

If it is determined in the step S9 that three hours has not yet elapsed, i.e. if the answer to the question of the step S9 is No, the program skips to a step S11, where it is determined whether or not the value of the flag G is "1". If the value of the flag G is "1", the lighting device 21 is lighted in the next step S12, and the value of the 2-second timer 68 is incremented by "1" in a step S13. In a step S14, it is determined whether or not the value of the 2-second timer 68 has reached 2 seconds. If the value has reached 2 seconds, the value of the flag G is set to "0" in a step S15, and the occasion number register 66 and the accumulation register 67 are cleared in a step S16.

In other words, in the mode for lighting the lighting device 21, the lighting device 21 is automatically turned off 2 seconds after it is turned on.

Thereafter, in a step S17, it is determined whether or not an attitude detection signal as the output signal of the attitude detection switch 19 has been detected. If detected, the program proceeds to a step S18, where detection processing is executed.

The detection processing in the step S18 will be explained with reference to the flowchart of FIG. 18.

First, in a step S51, the number of occasions in which the attitude detection switch 19 is turned on is counted, and the counted value is stored in the occasion number register 66. In a step S52, an accumulated period of time for which the attitude detection switch 19 is in the On-state is counted, and the counted value is stored in the accumulation register 67. In a step S53, it is determined whether or not the value of the occasion number register 66 exceeds 3. If the value is 3 or less, it is determined in a step S54 whether or not the accumulated time period obtained by the accumulation register 67 exceeds 250 ms.

If it is determined in the step S53 that the number of the occasions in which the attitude detection switch 19 is turned on exceeds 3, or if it is determined in the step S54 that the accumulated time period for which the attitude detection switch is turned on exceeds 250 ms, it is determined that the wristwatch 1 has taken a predetermined attitude, in other words, it is determined, for example, that the user has inclined the wristwatch 1 to watch the LCD 17 such that the 6-o'clock direction side of the wristwatch 1 is situated in the lowest position. In a step S55, the value of the flag G is set to "1" to light the lighting device 21.

If, on the other hand, the accumulated time period of the On-state of the attitude detection switch 19 is equal to or less than 250 ms, it is determined that the wristwatch 1 has not taken the attitude for enabling the LCD 17 to be watched, followed by the termination of the processing.

In summary, if it is determined that the number of the occasions in which the attitude detection switch 19 is turned on exceeds a predetermined number (e.g. 3), or if it is determined that the accumulated time period for which the attitude detection switch is turned on exceeds a predetermined time period (e.g. 250), the states of switches, which includes the attitude detection switch 19 of a structure whose On-state or Off-state is hard to keep in a reliable manner, can be accurately detected by lighting the lighting device 21.

After the detection processing in the step S18 of FIG. 16, display processing in a step S19 is executed. If in the display processing, the present operation mode is, for example, the stop-watch mode, a time period presently measured by the stop-watch function is displayed on the LCD 17.

Figure 20A:
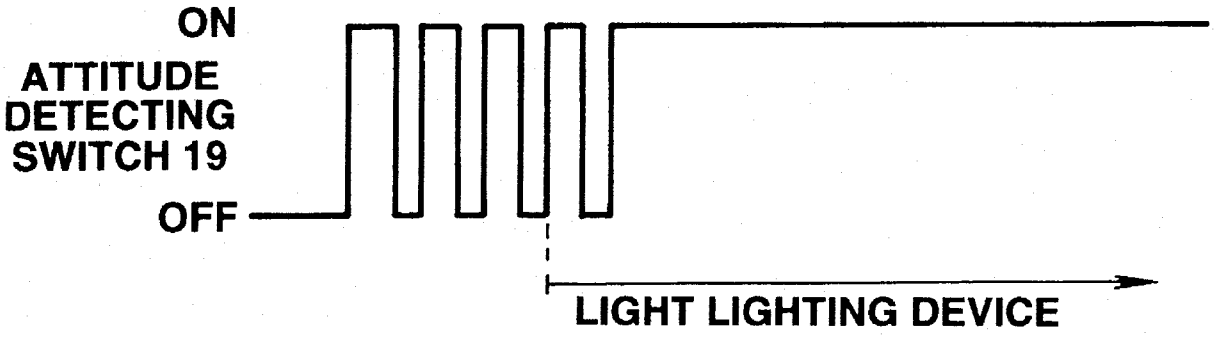
FIGS. 20A and 20B are views, showing detection signals of an attitude detection switch 19.
Figure 20B:
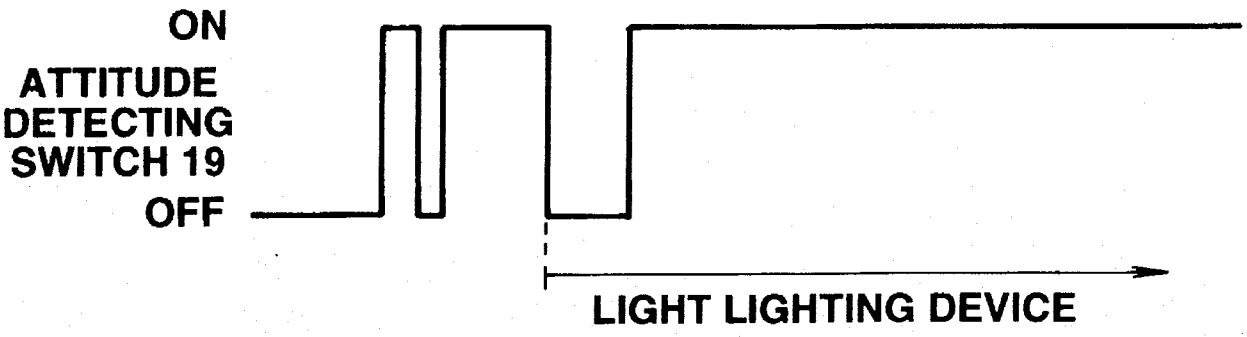

FIGS. 20A and 20B show the waveforms of signals output from the attitude detection switch 19. In these figures, the high level indicates the On-state of the switch 19, and the low level the Off-state of the same.

FIG. 20A shows the waveform of a signal obtained when the attitude detection switch 19 is repeatedly turned on and off. After the On-state and Off-state are repeated four times, it is determined that the user has inclined the wristwatch 1 such that the 6-o'clock direction side of the wristwatch is situated in the lowest position. As a result, the lighting device 21 is lighted.

FIG. 20B shows the waveform of a signal obtained when the On-state of the switch 19 has continued for 250 ms or more although the turn-on and -off are repeated only twice. After the On-state continues 250 ms or more, it is determined that the user has inclined the wristwatch 1 to watch the LCD 17 such that the 6-o'clock direction side of the wristwatch is situated in the lowest position. As a result, the lighting device 21 is lighted.

Although in the above-described embodiments, the lighting device 21 is lighted by the attitude detection switch 19 for 3 hours only in the stop-watch mode, the invention may be modified such that such control is done in other modes.

Moreover, the invention may be modified such that an operation switch for switching the value of the register L0 from "0" to "1" or "1" to "0" is employed, and that the attitude detection switch 19 is operated to light the lighting device 21 for a predetermined time period only when the value of the register L0 is set to "1" by the operation switch.

In addition, although in the above embodiments, the invention is applied to the electronic digital wristwatch, it is also applicable to an analog wristwatch with hands or to an electronic instrument other than the wristwatches. Furthermore, the structure of the attitude detection switch 19 is not limited to that employed in the embodiments.

As explained above, in the embodiments, the lighting device 21 is lighted while the key S3 is operated, so as to enable data on the LCD 17 to be read even in the darkness. Further, the lighting device 21 can be lighted and extinguished in accordance with the attitude of the instrument. Therefore, the lighting device can be lighted without switch operation, thus realizing an electronic instrument having an attitude detecting function easy to execute. Moreover, since the mode for facilitating the control of the turn-on and -off of the lighting device to accord with the attitude of the instrument, and the other modes can be selected, the lighting device is prevented from lighting when illumination is not necessary.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An electronic instrument provided with display means for displaying data and a lighting device for illuminating the display means, comprising:

attitude-detecting switch means for detecting an attitude of the electronic instrument and for outputting a switch signal when the electronic instrument assumes a predetermined attitude;

control data storing means for storing one of (i) operation control data for causing the lighting device to illuminate the display means, and (ii) non-operation control data for precluding the lighting device from illuminating the display means;

determining means for determining whether the control data storing means has stored therein the operation control data or the non-operation control data; and illumination operation control means for (i) controlling the lighting device to illuminate the display means when (a) the attitude-detecting switch means outputs the switch signal, and (b) the determining means determines that the control data storing means has stored therein the operation control data, and (ii) for precluding the lighting device from illuminating the display means when the determining means determines that the control data storing means has stored therein non-operation control data.

2. The electronic instrument according to claim 1, wherein the illumination operation control means includes time-measuring means for measuring a predetermined period of time, counting means for counting a number of pulses of the switch signal output by the attitude-detecting switch means during a time-measuring operation of the time-measuring means, and means for controlling the lighting device to illuminate the display means when the number of pulses counted by the counting means reaches a predetermined value.

3. The electronic instrument according to claim 1, wherein the display means comprises a liquid crystal display device, and the lighting device comprises an electroluminescence device.

4. The electronic instrument according to claim 1, wherein the attitude-detecting switch means includes a case, first and second stationary contacts located apart from each other in the case, and a conductive member movably contained in the case for electrically connecting the first and second stationary contacts to each other when the conductive member is situated in a predetermined position, thereby causing the switch signal to be output.

5. The electronic instrument according to claim 1, further comprising a selector switch for switching the electronic instrument between (i) a non-operation mode wherein the lighting device is precluded from illuminating the display means, and (ii) an operation mode wherein the lighting device is enabled to illuminate the display device when the switch signal is output from the attitude-detecting switch means.

6. The electronic instrument according to claim 5, further comprising indicating means for indicating whether the electronic instrument is set to the non-operation mode or the operation mode.

7. The electronic instrument according to claim 5, wherein the non-operation mode comprises at least a time display mode for displaying the present time, and the operation mode comprises at least a mode for displaying stop-watch data.

8. The electronic instrument according to claim 1, further comprising timer means for switching the electronic instrument to the non-operation mode at a predetermined time after the selector switch switches the electronic instrument to the operation mode.

9. The electronic instrument according to claim 1, further comprising present time-detecting means for detecting the present time, and wherein the present time is displayed on the display means.

10. The electronic instrument according to claim 1, wherein the display means, the lighting device, the attitude-detecting switch means and the illumination operation control means are disposed in a case of a wristwatch.

* * * * *